US008720360B2

(12) United States Patent
Kessler

(10) Patent No.: US 8,720,360 B2
(45) Date of Patent: May 13, 2014

(54) FLOTATION CONTROL SYSTEM

(76) Inventor: Leslie Kessler, Rockville, MD (US)

( * ) Notice: Subject to any disclaimer, the term of this patent is extended or adjusted under 35 U.S.C. 154(b) by 255 days.

(21) Appl. No.: 13/313,074

(22) Filed: Dec. 7, 2011

(65) Prior Publication Data

US 2013/0145979 A1 Jun. 13, 2013

(51) Int. Cl.

| | |
|---|---|
| ***B63B 21/24*** | (2006.01) |
| ***B63B 21/29*** | (2006.01) |
| ***B63B 35/58*** | (2006.01) |
| ***B63B 35/73*** | (2006.01) |

(52) U.S. Cl.

USPC ..... 114/294; 441/35; 441/129

(58) Field of Classification Search

CPC ..... B63B 21/20; B63B 21/22; B63B 21/227; B63B 21/24; B63B 21/26; B63B 21/29; B63B 21/30; B63B 21/46; B63B 21/50; B63B 35/58; B63B 35/607; B63B 35/613; B63B 35/73; B63B 7/06; B63B 7/08; B63B 7/082; B63B 7/085; B63C 9/04; B63C 2009/04; B63C 2009/042; B63C 2009/044; B63C 2009/046; B63C 2009/048

USPC ..... 114/293, 294; 441/35, 39–42, 129

See application file for complete search history.

(56) References Cited

U.S. PATENT DOCUMENTS

| | | | | |
|---|---|---|---|---|
| 1,148,924 | A * | 8/1915 | Paradise | 383/71 |
| 4,775,346 | A | 10/1988 | Gunter et al. | |
| 4,913,672 | A | 4/1990 | Martin | |
| 4,922,847 | A * | 5/1990 | Ryder et al. | 114/299 |
| 5,410,981 | A | 5/1995 | Gutstein et al. | |
| 6,666,161 | B1 | 12/2003 | Cannon et al. | |
| 2002/0026890 | A1 * | 3/2002 | Zook et al. | 114/294 |

FOREIGN PATENT DOCUMENTS

| | | | |
|---|---|---|---|
| GB | 2382061 | A * | 5/2003 |
| WO | WO 2007014670 | A1 * | 2/2007 |

* cited by examiner

*Primary Examiner* — Ajay Vasudeva

(74) *Attorney, Agent, or Firm* — Michael L. Greenberg, Esq.; Greenberg & Lieberman, LLC

(57) ABSTRACT

A flotation control system that allows a user to place a first anchor base and a second anchor base operating in conjunction with respective retractable lines at opposite ends of an inflatable float. Each retractable line is secured to an outer bag that is used to protect an internal inner bag. The inner bag is filled with sand and sealed so that the outer bag, inner bag, and sand form an anchor. A user will release two anchors at opposite ends of the float. This function affords the user control over direction and drift.

13 Claims, 4 Drawing Sheets

FLOTATION CONTROL SYSTEM

FIELD OF THE PRESENT INVENTION

The present invention relates to at least one retractable anchor attached to a personal flotation device in order to maintain directional control and inhibit drift. In addition, the present invention provides a means to seamlessly remove the weighting elements from the anchor, with the anchor being comprised of an inner bag and an outer bag.

BACKGROUND OF THE PRESENT INVENTION

Relaxing on inflatable rafts and floats is a popular activity. This is particularly true in swimming pools where users are accustomed to lazily floating about. But inflatable rafts and floats, due to natural drift caused by waves and currents, can prove dangerous when used on natural bodies of water such as ponds, lakes and oceans. In such locales, a user must constantly remain vigilant about his or her location and drift, yet current methods of restricting drift on flotation devices force the user to actively and physically work to ensure drift and spin does not occur. As a result, the use of such floats is not as relaxing.

In addition, statistics show that drowning is one of the most common deadly dangers for people at the beach. In fact, a major cause of drowning is when a person is caught in the rip current. While one may assume this only applies to swimmers, the fact remains that someone on a raft may ultimately catch a rip current and the raft will drift off into a dangerous location on the water. From there, the user may have to struggle to return to shore. In the end, the relaxing purpose of using an inflatable raft or float is diminished due to drift. As such, there is a need for a system that inhibits the natural drift of a float so that the float and user will remain relatively stationary. The present invention solves this need by employing a durable anchor made of a heavy-duty outer bag, an attached inner bag, and a retractable line.

Another issue relevant to inflatable rafts and floats is direction. The drift of natural bodies of water not only causes typical flotation devices to move through the water, but also to spin or otherwise point in various directions. Implications for a user relate to such common activities as sunbathing, avoiding direct sun, vertigo and sun glare. As such, there is a need for a system that not only maintains stationary positioning, but also provides the user with directional and spin control. The present invention solves this need by attaching an anchor to one end of the float via a first line, while also attaching in certain embodiments a second anchor to another end of the float via a second line.

U.S. Pat. No. 4,913,672 issued to Martin on Apr. 3, 1990 is an anchor for beach air mattresses or rafts. Martin relates to a unitary vinyl storage pouch that is filled with sand before being closed via a drawstring that attaches to the raft. In contrast, the present invention's anchor is an inner bag filled with sand and fitted into a heavy-duty outer bag, with the inner bag closed independently of the outer bag and the outer bag attached to the float via a retractable line. This design of anchor in the present invention differs from existing items, such as Martin, that undergo a loss of sand and consequently slowly lose the weight of the anchor through the drawstring. The result is that existing items such as Martin ultimately go back to unwanted drifting because, by losing sand, those items lose anchoring capability. The present invention solves the problem of sand loss through the anchor's configuration with the outer bag and inner bag.

U.S. Pat. No. 5,410,981 issued to Gutstein et al. on May 2, 1995 is an anchoring kit for use with a flotation device. Gutstein et al. employs an anchor with an outer casing filled with a dense glandular filling that is hooked to a limb of a person on a flotation device. The present invention differs greatly from Gutstein et al. in that the present invention ties the anchor weight to the float, not to the body of the user of the float. In addition, the outer casing of Gutstein et al.'s anchor is a unitary storage case that contains filling. In contrast, the present invention utilizes an inner bag that is filled with sand (or other weighted material) and fitted inside a heavy-duty outer bag that further covers the sand so there is no inadvertent loss of weight. The outer bag is connected to the float via a retractable line while the inner bag is closed independently of the outer bag.

U.S. Pat. No. 4,775,346 issued to Gunter et al. on Oct. 4, 1988 is an apparatus for anchoring a flotation device. Gunter employs adjustable straps that must be attached to corresponding straps secured to a vertical wall, such as that of a swimming pool, in order to achieve directional control. In contrast, the present invention holds the float in place by means of at least one anchor that can be moved into optimal position by means of the anchor base apparatus on the float.

U.S. Pat. No. 6,666,161 issued to Cannon et al. on Dec. 23, 2003 is a raft with an anchoring system for use in swimming pools. Cannon employs a unitary weighted member to be dropped to the bottom of the swimming pool, with the weighted member being linked via a strap to a second weighted member attached to the float, thus requiring two unitary weights for the singular anchor to work. In contrast, the present invention can function with one weighted anchor, and provides the user the ability to move the anchor into an optimal position.

While the idea of anchoring a flotation device is known, there remains a need for a system that provides the user with optimal directional control and the ability to extend and retract the line between the float and the anchor. In addition, the need continues for the best way of protecting and maintaining the recyclable weight of the anchor. The present invention solves these needs by employing a retractable line that enables the user to place the weight at its required depth, while also making it easier for the user to easily retrieve the anchor via two hooks on the outer bag that also aid in removing sand from the anchor's inner bag.

SUMMARY OF THE PRESENT INVENTION

The present invention is a flotation control system that incorporates an anchoring system for use with an inflatable float. In this manner, the present invention gives a user the ability to prevent drifting in bodies of water such as pools, ponds, lakes and oceans. At the same time, the anchors and their attachments to the float cause the float to remain in place and face a specific direction while in use on the water. The present invention also includes features to control the anchor, such as an anchor base apparatus that enables the user to extend and retract the anchor line (herein referred to as "line") and anchor, and a system of hooks that allow the user to easily empty the anchor's weighted material.

The preferred embodiment of the present invention is such that a first anchor base is placed on one end of the float and a second anchor base is placed on another end of the float. Each anchor base releases a line connected to an anchor, so that two anchors are placed in the water to keep the float in a stationary position. In this configuration, the float will not spin due to the placement of the first anchor and the second anchor. However, it should be noted that the present invention only requires one anchor to prevent the float from drifting. The anchor itself is formed via a heavy-duty outer bag that contains an attached inner bag. The outer bag and inner bag are attached to each other by conventional means (e.g., the inner bag can be sewn into the outer bag). The outer bag has at its summit a hook, or first hook, attached to the retractable line extending from the anchor base described above. Leading from the first hook to a second hook, placed on the bottom or side of the outer bag, is a short line, or leash.

The inner bag holds weighted material such as sand, and has a flap or drawstring so that the user may fill the inner bag of the anchor with weighted material such as sand, then seal the inner bag by means of the flap or drawstring. The outer bag of the anchor, attached at its first hook to the line leading back to the float, is closed by an enclosing mechanism such as a clasp or drawstring. When the user retracts the line and anchor back to the surface of the water, the user can open the outer bag by unfastening an enclosing mechanism such as a clasp or drawstring. Then the user can unhook the line from the first hook, which will leave the line connected to the anchor at the second hook via the leash. This will cause the anchor to turn upside down so that the inner bag will open and the sand, or other weighted substance, will fall out of the anchor.

On the float itself, connected to the line and serving to retract and extend it, is an anchor base that can be moved to different locations on the float, allowing the user to place the at least one anchor in an optimal location. The anchor base uses a conventional line extension and retraction system to gather the line, although a different embodiment of the present invention envisions an anchor base that requires the user to manually release and retract the line.

DETAILED DESCRIPTION OF THE PREFERRED EMBODIMENT

Figure 1:
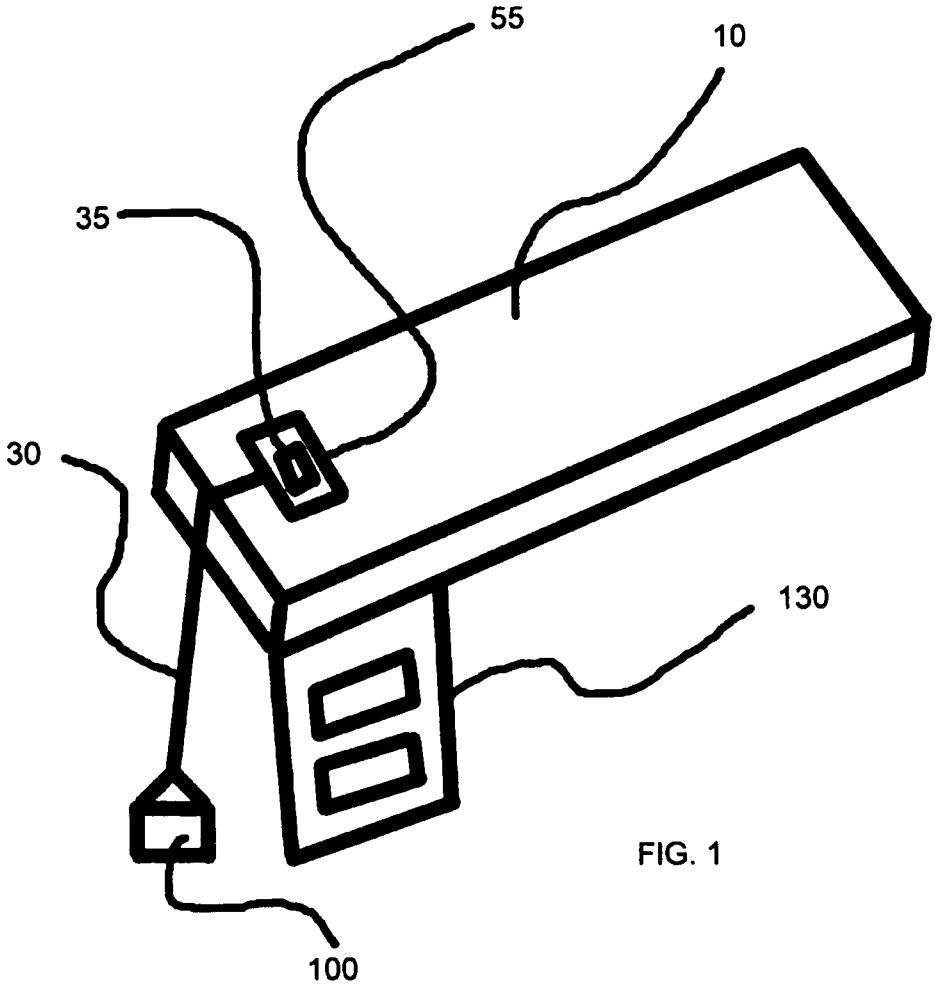
FIG. 1 is a view of an example of the present invention in use.

The present invention relates to a means of preventing drift while providing directional control in regard to an inflatable float (10). This is accomplished by means of at least one anchor base (35), line (30), and anchor (100). The anchor base (35) is placed within the float (10), from where the anchor base (35) extends and retracts the line (30) that connects to the anchor (100) placed into a body of water to secure the float (10) in a stationary position. The anchor base (35) can be positioned at any point along the side of the float (10) so that the anchor (100) can be placed in an optimal location.

In the preferred embodiment of the present invention, the anchor base (35) operates according to conventional principles, facilitating the conventional functions of retraction and extension of the line (30) by means of a switch (55) on the anchor base (35). When the user engages the switch (55) and drops the anchor (100), the line (30) will uncoil from the anchor base (35) and settle at the bottom of the body of water. The anchor (100) will then secure the float (10) in a stationary position. In another embodiment of the present invention, the anchor base (35) will not have a switch (55) that extends and retracts the line (30). Rather, the user will manually release and retract the line (30) that has on one end the anchor (100) and on the other end the anchor base (35).

The anchor (100) is composed of an outer bag (40), inner bag (50), and weighted material placed within the inner bag (50). To prepare the anchor (100) for use, the user will open or unfold the outer bag (40) and then open the inner bag (50) at the inner bag flap (60). The user then can gather sand from the beach and place it into the inner bag (50) so that the inner bag (50) is nearly full. The user then closes the inner bag flap (60), followed by securing the outer bag (40). This process should be conducted for each anchor (100) employed by the user.

FIG. 1 shows an embodiment of the present invention in operation, with one anchor base (35), line (30), and anchor (100) employed on the float (10). The anchor base (35) is shown positioned on the edge of the float (10) and extending the line (30) and anchor (100) in order to hold the float (10) in position. The anchor base (35) operates according to conventional principles, extending and retracting the line (30) as needed through engaging a switch (55) on the anchor base (35) that both extends and retracts the line (30). When the switch (55) is engaged and the anchor (100) is dropped into the water, the line (30) will extend from the anchor base (35) to the underwater surface, and the anchor (100) will secure the float (10) in a stationary position. When the user wishes to retract the anchor (100), the user will engage the switch (55) on the anchor base (35) in order to retract the line (30) via conventional means. The anchor base (35) is envisioned as capable of retracting the line (30) commensurate with the weight (estimated at about 40 pounds) of the anchor (100) so that the user will not have to lift the anchor (100) out of the water. However, due to the heaviness of the anchor (100), another embodiment of the anchor base (35) is envisioned as requiring the user to manually extend and retract the anchor (100) and line (30). In this embodiment, the user would need to manually pull up the anchor (100) via the line (30) in order to create slack in the line (30) that can then be gathered into the anchor base (35). After the anchor (100) has been lifted to the surface of the water, the user can then dump or otherwise remove the sand or other contents of the anchor (100).

Figure 2:
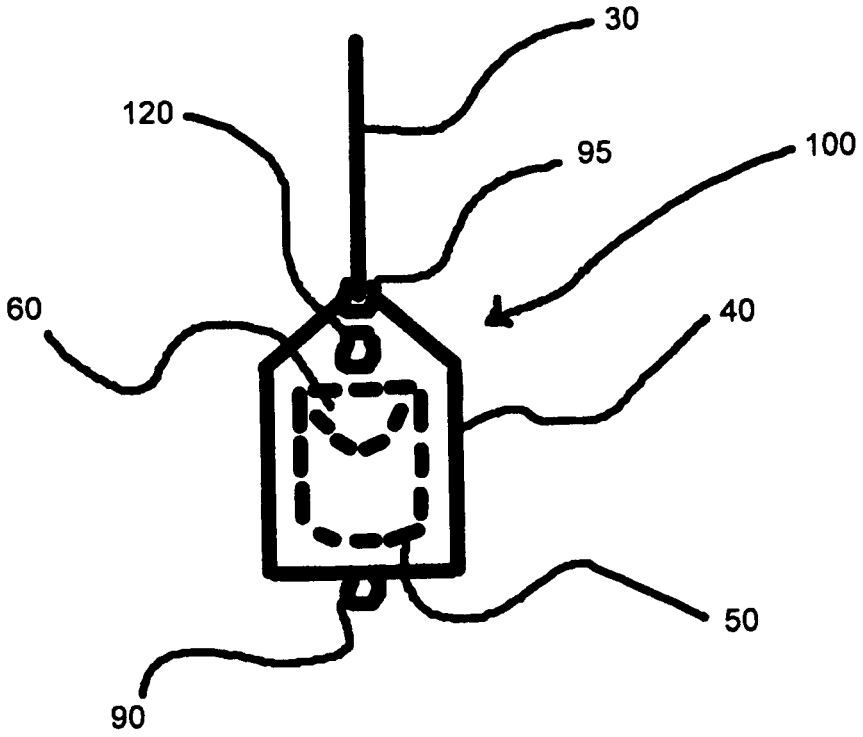
FIG. 2 shows the front view of the anchor of the present invention, connected to the line and with the outer bag shut to enclose the inner bag.
Figure 3:
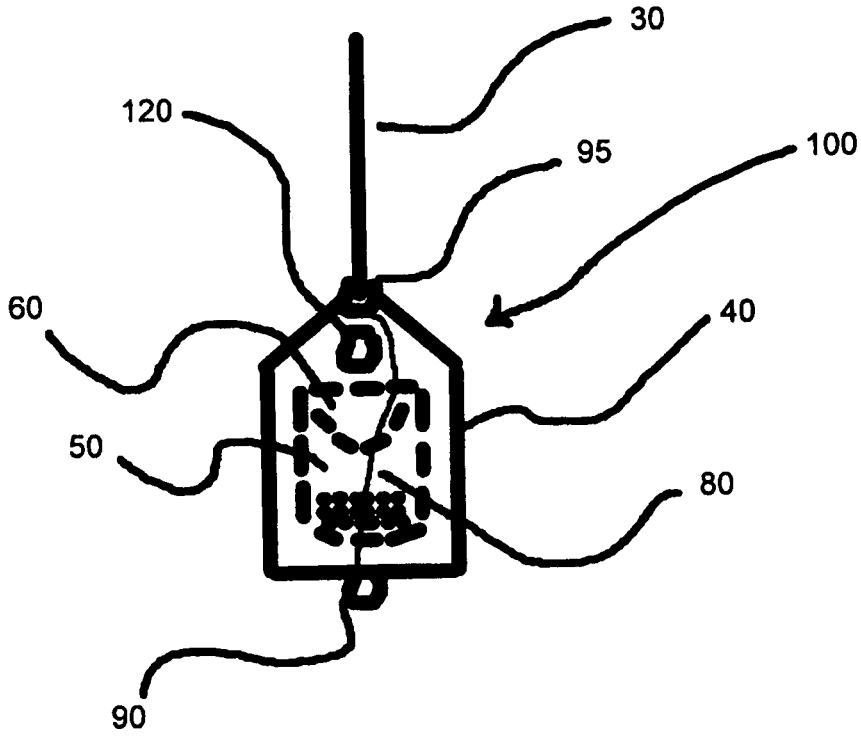
FIG. 3 shows the rear view of the anchor of the present invention, connected to the line and with the outer bag shut to enclose the inner bag.

FIG. 2 shows a front view and FIG. 3 shows a rear view of the preferred embodiment of the anchor (100). On the outer bag (40) of the anchor (100) are two hooks, a first hook (95) and a second hook (90). The first hook (95) is attached to the top of the outer bag (40), and the second hook (90) is attached to either the bottom or side of the outer bag (40). The line (30) is connected to the first hook (95) and is also connected via conventional means to a short line, or leash (80) (not shown in FIG. 2, see FIG. 3) that connects to the second hook (90). Therefore when the anchor (100) is dropped down into the water, the first hook (95), located at the top of the outer bag (40), is holding the weight of the anchor (100). When the user retracts the line (30) and anchor (100) back to the surface of the water, the user can open the outer bag (40) by unfastening an enclosing mechanism (120). The enclosing mechanism (120) is shown as a clasp in FIG. 2 & FIG. 3, although it could be another conventional means of closing shut the outer bag (40), such as a drawstring. Then the user can unhook the line (30) from the first hook (95), which will leave the line (30) connected only to the second hook (90) via the leash (80) (see FIG. 3). This will cause the anchor (100) to turn upside down so that the inner bag (50) will open and the sand, or other weighted substance, will fall out of the anchor (100).

The outer bag (40) is a pouch or other type of container that contains an inner bag (50) (shown in silhouette in FIG. 2 &

FIG. 3). The inner bag (50), which can be sewn or otherwise attached to the outer bag (40), is pliable and formed to hold weighted or granulated material such as sand. (When the present invention is being used in a controlled environment such as a swimming pool, the weighted material should be something that won't cause an environmental issue in the water or on the floor.) The inner bag (50) opens and closes at the top by means of an inner bag flap (60), so that sand or other weighted material can be placed and secured inside the inner bag (50). (It is important to note that while the inner bag (50) is described here as closing with an inner bag flap (60), it also can close via a drawstring or other conventional mechanism.) The outer bag (40) will then be closed over the inner bag (50), via an enclosing mechanism (120), such as a clasp or other conventional means, to offer additional waterproof protection for the inner bag (50) and its contents. In this manner, the inner bag flap (60) covers the sand, white the outer bag (40) covers the inner bag (50). When the user has retracted the line (30) and anchor (100) back to the surface of the water, the user can then unhook the line (30) from the first hook (95), which will leave the line (30) connected only to the second hook (90) via the leash (80) (see FIG. 3), causing the anchor (100) to turn upside down so that the sand or other weighted material will fall out of the inner bag (50).

Figure 4:
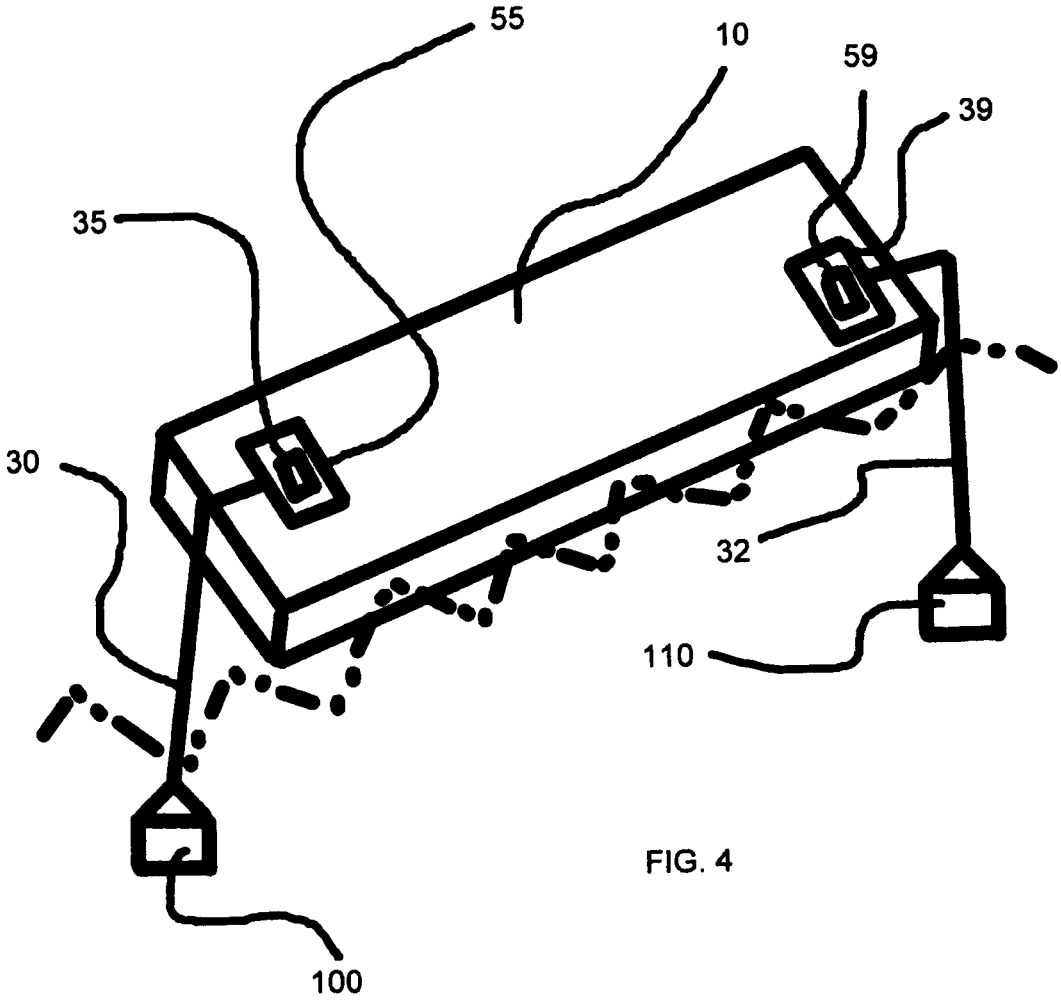
FIG. 4 is a view of the preferred embodiment of the present invention in use.

FIG. 4 shows the preferred embodiment of the present invention. The preferred embodiment envisions an anchor base (35) and a second anchor base (39) placed in the float (10), with the anchor base (35) located at the bottom end of the float (10) and the second anchor base (39) located at the top end of the float (10). The anchor base (35) is used for the anchor (100), and the second anchor base (39) for the second anchor (110). While the weight of just the anchor (100) will prevent the float (10) from drifting, placing the second anchor (110) at a position on the opposite end of the float (10), as in FIG. 4, will weigh down two ends of the float (10) in a manner that inhibits spinning or changes in direction. When the user wishes to change the position of the float (10), the user can slide the anchor base (35) and the second anchor base (39) into different positions. The preferred embodiment of the present invention envisions anchors (100 and 110) that accommodate about 40 pounds of sand each. The user also may extend or retract the lines (30 and 32) to adjust the desired amount of drift for the float (10). The lines (30 and 32) are envisioned as displaying markers or demarcations in terms of depth to inform the user how deeply the anchors (100 and 110) have sunk into the water.

Continuing with the depiction in FIG. 4, when the user wishes to retract the anchors (100 and 110), the user will engage the switches (55 and 59) on the anchor bases (35 and 39). When the switches (55 and 59) are activated, the anchor bases (35 and 39) will retract the lines (30 and 32) via conventional means. The anchor bases (35 and 39) are envisioned as capable of retracting the lines (30 and 32) commensurate with the weight (estimated at about 40 pounds) of the anchors (100 and 110) so that the user will not have to lift the anchors (100 and 110) out of the water. However, another embodiment of the anchor bases (35 and 39) envisions the user manually pulling up the anchors (100 and 110) via the lines (30 and 32) in order to create slack in the lines (30 and 32) that can then be retracted by the anchor bases (35 and 39). After the anchors (100 and 110) have been lifted to the surface of the water, the user can then dump or otherwise remove the contents of the anchors (100 and 110) as described above.

In addition to the above, the preferred embodiment is such that the float (10) is configured via conventional means to flatten when not in use. This means that the present invention can be taken anywhere as a travel device. A conventional pump may be included to help the user inflate the float (10). The float (10) itself in the preferred embodiment is configured so that the bottom of the float (10) is clear, allowing the user to look through the float (10) and into the water beneath.

Other embodiments envision the anchor (100), once filled with weighted material, placed on steps (130) configured onto the float (10). The steps (130) are envisioned as attached to the float (10) in a location such that the user can place the anchor (100) on the steps (130) and unhook the steps (130) from the float (10), so that the anchor (100) will fall into the water. The release from the steps (130), coupled with the weight of the sand or other weighted contents of the inner bag (50), will force the anchor (100) straight downward into the water.

In summary, the present invention is a flotation control system, securing at least one line (30) to a float (10), and forming an anchor (100) made up of an outer bag (40), an inner bag (50), a first hook (95) and a second hook (90), with the at least one line (30) configured to extend from the float (10) such that an end of the at least one line (30) is connected to the first hook (95) of the outer bag (40). The anchor (100) has an inner bag (50) within an interior of the outer bag (40), the inner bag (50) formed to house a weighted material and configured to open and close such that the weighted material is contained within the inner bag (50), with the outer bag (40) covering the inner bag (50) and the interior of the outer bag (40).

Use of the present invention involves releasing the anchor (100) from the float (10) and into the water when the weighted material is secured into the inner bag (50) and the outer bag (40) is secured to the float (10) via the at least one line (30), with the line (30) connected to the outer bag (40) via the first hook (95), and a leash (80) connecting between the line (30) and the second hook (90), the second hook (90) operating in conjunction with the outer bag (40), and allowing the user to dump the granulated material upon retraction of the line (30) by unhooking the line (30) from the first hook (95) such that the line (30) is in communication with the float (10) and the second hook (90) via the leash (80).

In addition, the line (30) passes through an anchor base (35), the inner bag (50) is more pliable than the outer bag (40), and the inner bag (50) and the interior of the outer bag (40) are covered via an enclosing mechanism (120). Furthermore, a second line (115) is connected to a second anchor (110) such that the second line (115) and the second anchor (110) operate in the same manner as the line (30) and the anchor (100), the second line (115) and the second anchor (110) being separated from the line (30) and the anchor (100), and the anchor (100) being released from one side of the float (10) and the second anchor (110) being released from a side of the float (10) that is opposite from the anchor (100). The present invention further comprises attaching steps (130) to the float (10) such that the steps (130) can be unfurled into the water for launching the anchor (100) from the steps (130) when the steps (130) are unfurled from the float (10).

In addition, the flotation control system calls for placing the first hook (95) on the top side of the outer bag (40) and the second hook (90) on the bottom of the outer bag (40), configuring the line (30) such that the line (30) is retractable, configuring the anchor base (35) such that the anchor base (35) has a switch (55) to facilitate retraction of the line (30), forming the float (10) such that the bottom of the float (10) is clear, and securing the at least one line (30) to the float (10) via an anchor base (35). The flotation control system further comprises releasing the anchor (100) from the float (10) and into the water when the weighted material is secured into the inner bag (50) and the outer bag (40) is secured to the float (10) via the at least one line (30) such that the first hook (95)

on top of the outer bag (40) is in direct contact with the line (30) while the second hook (90) is attached to the same line (30) as the first hook (95). The present invention also comprises attaching the second hook (90) to a side of the anchor (100), the second hook (90) having a leash (80) that is lax such that when the anchor (100) is brought up to water level, the first hook (95) is configured to be unhooked such that the anchor (100) will turn upside-down while maintaining a connection with the second hook (90). Lastly, the present invention further comprises attaching the second hook (90) to a bottom of the anchor (100), the second hook (90) having a leash (80) that is lax such that when the anchor (100) is brought up to water level, the first hook (95) is configured to be unhooked such that the anchor (100) will turn upside-down while maintaining a connection with the second hook (90).

Having illustrated the present invention, it should be understood that various adjustments and versions might be implemented without venturing away from the essence of the present invention. The present invention is not limited to the embodiments described above, and should be interpreted as any and all embodiments within the scope of the following claims.

I claim:

1. A flotation control system, comprising:

at least one line having first and second ends, the line secured to a float at the first end and releasably secured to an anchor at the second end;

the anchor comprising a ballast bag having an inner bag and an outer bag, the inner bag disposed within an interior of the outer bag and configured to house a weighted material, the inner and outer bags each having a closing mechanism for selectively closing and opening the inner and outer bags, the outer bag further comprising a first hook and a second hook on an outer surface thereof, the first hook disposed proximate an upper side of the outer bag and the second hook disposed proximate a lower side of the outer bag;

a weighted material comprising granulated material being housed within the inner bag;

a leash extending between the second end of the line and the second hook, the leash being releasably secured to the second hook;

wherein the anchor is deployed by lowering the ballast bag from the float with the second end of the line being attached to the first hook and the leash being attached to the second hook; and wherein the ballast bag is configured to be emptied by releasing the line from the first hook such that the line and the leash are attached only to the second hook, opening the closing mechanism of the inner and outer bags, and retracting the line to invert the ballast bag so that the granulated material is dumped out of the opened bags.

2. The flotation control system of claim 1, wherein the first hook is disposed at an upper edge of the outer bag.

3. The flotation control system of claim 1, wherein the second hook is disposed at a lower edge of the outer bag.

4. The flotation control system of claim 1, wherein the inner bag is more pliable than the outer bag.

5. The flotation control system of claim 1, further comprising a second line secured to the float, the second line extending between the float and a second anchor, wherein the second line and the second anchor are configured to operate in the same manner as the at least one line and the anchor.

6. The flotation control system of claim 5, wherein the anchor is secured at one side of the float and the second anchor is secured an opposing side of the float.

7. The flotation control system of claim 1, further comprising boarding steps attached to the float, wherein the boarding steps are configured to be unfurled into the water.

8. The flotation control system of claim 1, wherein the at least one line is retractable using a retraction mechanism.

9. The flotation control system of claim 1, wherein the closing mechanism is selected from a group consisting of a flap and a drawstring.

10. The flotation control system of claim 1, the float is a personal flotation device.

11. A method of flotation control of a float, comprising:

providing the flotation control system of claim 1;

deploying the anchor by lowering the ballast bag from the float and into the water when the weighted material is secured inside the inner bag and the outer bag is secured to the float via the at least one line such that the first hook of the outer bag is in direct contact with the line while the second hook is operably connected to the line.

12. The method of flotation control of claim 11, further comprising:

operably connecting the line to the second hook is achieved by connecting the leash between the second end of the line and the second hook.

13. The method of flotation control of claim 12, further comprising:

retracting the anchor toward the float;

releasing the line from the first hook such that the line and the leash remain attached only to the second hook;

opening the closing mechanism of the inner and outer bags; and retracting the line to invert the ballast bag so that the granulated material is dumped out of the opened bags.

* * * * *